US007703505B2

(12) United States Patent
So et al.

(10) Patent No.: US 7,703,505 B2
(45) Date of Patent: Apr. 27, 2010

(54) MULTIFLUID TWO-DIMENSIONAL HEAT EXCHANGER

(75) Inventors: Allan K. So, Mississauga (CA); Mark S. Kozdras, Oakville (CA)

(73) Assignee: Dana Canada Corporation, Oakville, Ontario (CA)

( * ) Notice: Subject to any disclaimer, the term of this patent is extended or adjusted under 35 U.S.C. 154(b) by 124 days.

(21) Appl. No.: 11/563,097

(22) Filed: Nov. 24, 2006

(65) Prior Publication Data

US 2008/0121382 A1 May 29, 2008

(51) Int. Cl.
*F28D 7/06* (2006.01)

(52) U.S. Cl. ..... 165/140; 165/153; 165/176

(58) Field of Classification Search ..... 165/140, 165/152, 153, 166, 167, 175, 176
See application file for complete search history.

(56) References Cited

U.S. PATENT DOCUMENTS

| | | | | |
|---|---|---|---|---|
| 3,207,216 | A | 9/1965 | Donaldson | |
| 3,537,513 | A | 11/1970 | Austin et al. | |
| 4,002,201 | A | 1/1977 | Donaldson | |
| 4,081,025 | A | 3/1978 | Donaldson | |
| 4,249,597 | A | 2/1981 | Carey | |
| 4,327,802 | A | 5/1982 | Beldam | |
| 5,462,113 | A | 10/1995 | Wand | |
| 5,538,077 | A | 7/1996 | So et al. | |
| 5,720,341 | A | 2/1998 | Watanabe et al. | |
| 5,884,696 | A | 3/1999 | Loup | |
| 5,964,280 | A | 10/1999 | Wehrmann et al. | |
| 5,964,282 | A | 10/1999 | Seiler et al. | |
| 6,142,221 | A | 11/2000 | Johansson | |
| 6,164,371 | A | 12/2000 | Bertilsson et al. | |
| 6,305,466 | B1 * | 10/2001 | Andersson et al. | 165/140 |
| 6,786,276 | B2 * | 9/2004 | Samy et al. | 165/174 |
| 6,889,758 | B2 * | 5/2005 | Burgers et al. | 165/148 |
| 6,923,251 | B2 * | 8/2005 | Higashiyama | 165/153 |
| 7,051,789 | B2 * | 5/2006 | Sheppard | 165/67 |
| 2005/0098308 | A1 * | 5/2005 | Sohn | 165/153 |
| 2005/0121179 | A1 * | 6/2005 | Shibagaki et al. | 165/153 |
| 2005/0133210 | A1 * | 6/2005 | Inagaki et al. | 165/152 |
| 2005/0150646 | A1 | 7/2005 | Calhoun et al. | |
| 2007/0044946 | A1 * | 3/2007 | Mehendale et al. | 165/153 |

FOREIGN PATENT DOCUMENTS

| | | |
|---|---|---|
| JP | 61059188 | 3/1986 |

* cited by examiner

*Primary Examiner*—Teresa J Walberg
(74) *Attorney, Agent, or Firm*—Ridout & Maybee LLP

(57) ABSTRACT

A heat exchanger has at least three tubular conduits spaced apart for the flow of air between and around the conduits. The conduits communicate with inlet and outlet manifolds for the flow of a first liquid through the conduits. An intermediate conduit is located between at least two, but not all, of the spaced-apart tubular conduits, and the intermediate conduit has inlet and outlet openings for the flow of a second liquid through the intermediate conduit.

18 Claims, 6 Drawing Sheets

MULTIFLUID TWO-DIMENSIONAL HEAT EXCHANGER

FIELD OF THE INVENTION

This invention relates to heat exchangers, and in particular, to heat exchangers for transferring heat energy between more than two fluids.

BACKGROUND OF THE INVENTION

In some applications, such as automotive vehicle manufacturing, it is common to have multiple heat exchangers for cooling or heating various different fluids that are used in the application. For example, in the case of an automobile, it is common to have a radiator for cooling the engine coolant, and one or more other heat exchangers for cooling such fluids as engine oil, transmission oil or fluid, power steering fluid, fuel, etc. Usually, air is used to cool the engine coolant, and often the engine coolant itself is used to cool the other fluids, such as engine or transmission oil or power steering fluid. As may be appreciated, this usually involves a lot of plumbing, and in automotive applications, it is highly undesirable to have too many components that need to be assembled into the automobile, as that increases the cost of assembly, provides more components that can break down, and it takes up valuable space, which is always in short supply.

In an attempt to reduce the amount of plumbing required and to save space, it has been proposed to combine two heat exchanger functions or heat exchanger subassemblies into a combination heat exchanger, where one of the fluids, such as engine coolant is shared between the two subassembly heat exchangers. An example of this is shown in U.S. Pat. No. 4,327,802 issued to Beldam, where the same engine coolant used in the radiator is used in an oil cooler subassembly formed integrally with the radiator. In this Beldam heat exchanger, air is used to cool engine coolant and in turn, the engine coolant is used to cool oil.

U.S. Pat. No. 5,884,696 (Loup) is another combination heat exchanger, where interleaved fluid flow passages are used to put two heat exchangers in parallel and reduce the overall size of what would otherwise be too separate heat exchangers. In this device, adjacent flow passages for the two heat exchange fluids, such as engine coolant and refrigerant, are separated by air passages for heat transfer between the two heat exchange fluids and the air.

Yet another example of a combination heat exchanger where heat energy is transferred between a common fluid and two other fluids is shown in U.S. Pat. No. 5,462,113. In this device, two refrigerant circuits with alternating spaced-apart flow passages are provided, and a third heat exchange fluid, such as water, surrounds all of the refrigerant circuit flow passages, so that maximum exposure of the water to the refrigerant is achieved.

While all of the above-mentioned prior art devices achieve the desired result of compact design and simplification of the plumbing, they are primarily concerned with transferring heat between one common fluid and two other fluids. They are not very efficient at transferring heat energy between the two other fluids per se.

SUMMARY OF THE INVENTION

In the present invention, three or more fluid passages or conduits are provided where heat energy can be transferred from one to the other in different operating conditions.

According to one aspect of the invention, there is provided a heat exchanger comprising a plurality of spaced-apart, elongate, double tube conduits. The conduits each include a pair of tubes having internal flow passages. One of the tubes has a raised peripheral edge portion joined to the other tube to define an intermediate flow channel between the tubes. The double tube conduits have opposed end portions. A first pair of manifolds includes a first inlet manifold and a first outlet manifold located respectively at the opposed end portions in communication with the internal flow passages. Also, a second pair of manifolds is in communication with the intermediate flow channel. The second pair of manifolds includes a second inlet manifold and a second outlet manifold. The first inlet manifold is nested beside one of the second inlet and outlet manifolds, and the first outlet manifold is nested beside the other of the second inlet and outlet manifolds.

According to another aspect of the invention, there is provided a liquid to air heat exchanger comprising at least three tubular conduits defining internal flow passages therein for the flow of a first liquid through the heat exchanger. The tubular conduits have opposed end portions and are spaced apart for the flow of air between and around the conduits. A first pair of manifolds includes an inlet manifold and an outlet manifold located respectively at the opposed end portions in communication with the internal flow passages. An intermediate conduit is located between at least two, but not all, of the spaced-apart, tubular conduits. Also, the intermediate conduit includes inlet and outlet openings for the flow of a second liquid through the intermediate conduit for heat transfer between the first and second fluids.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENTS

Figure 1:
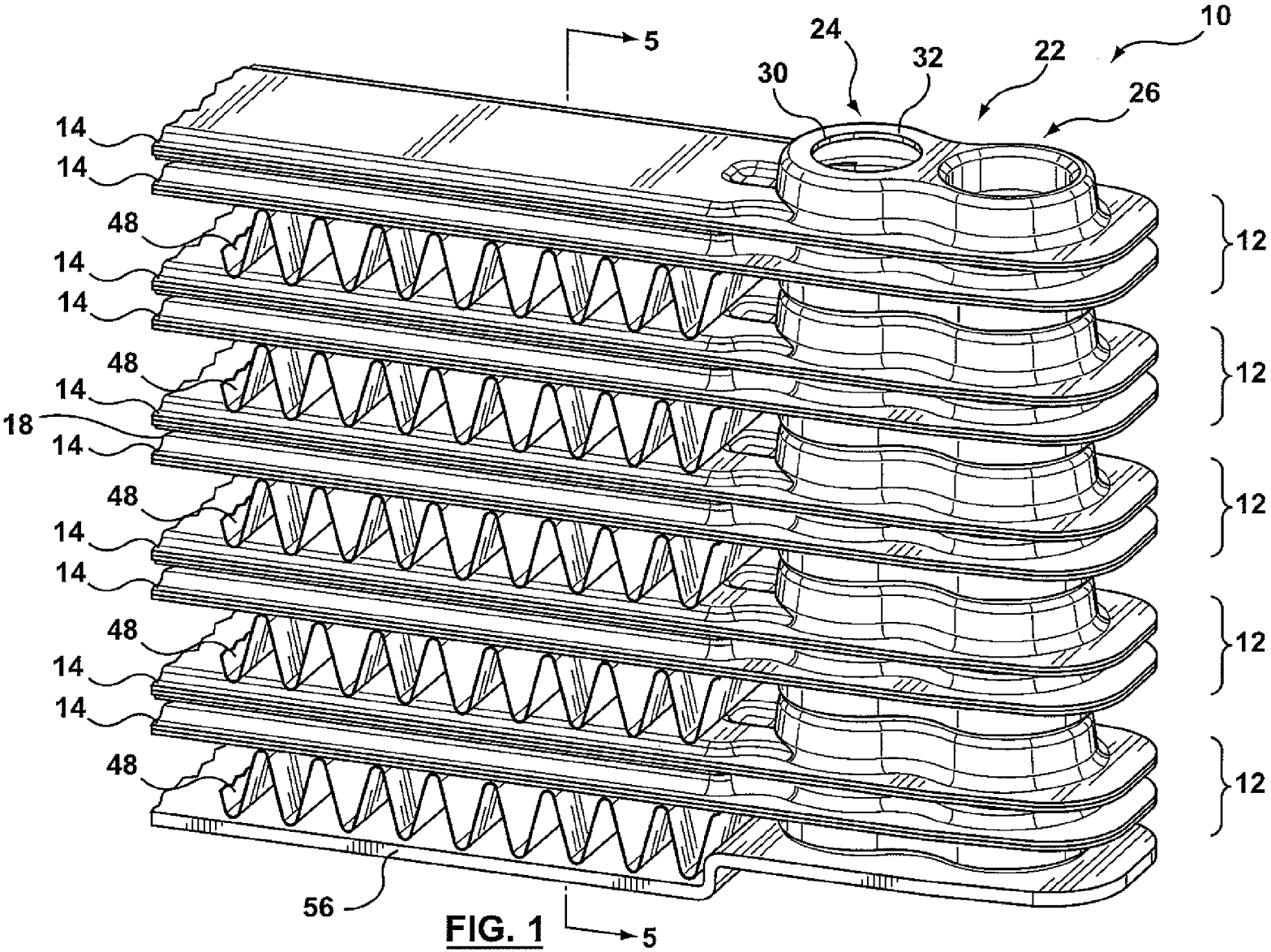
FIG. 1 is a perspective view of the right side or end of a preferred embodiment of a heat exchanger according to the present invention, the left side or end being the mirror image of the right side.
Figure 2:
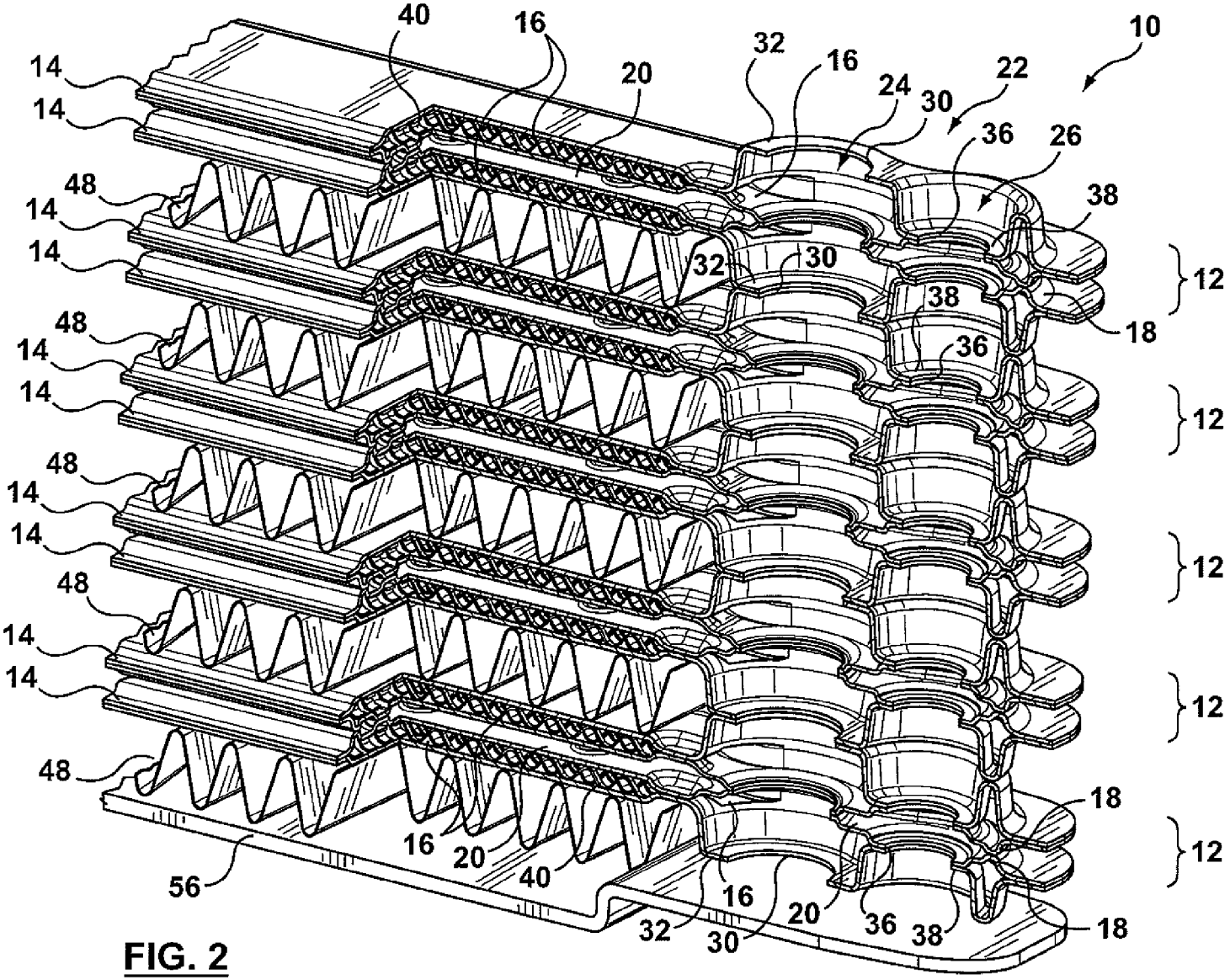
FIG. 2 is a perspective view similar to FIG. 1, but partly broken away to show the interior of the tubular conduits.
Figure 3:
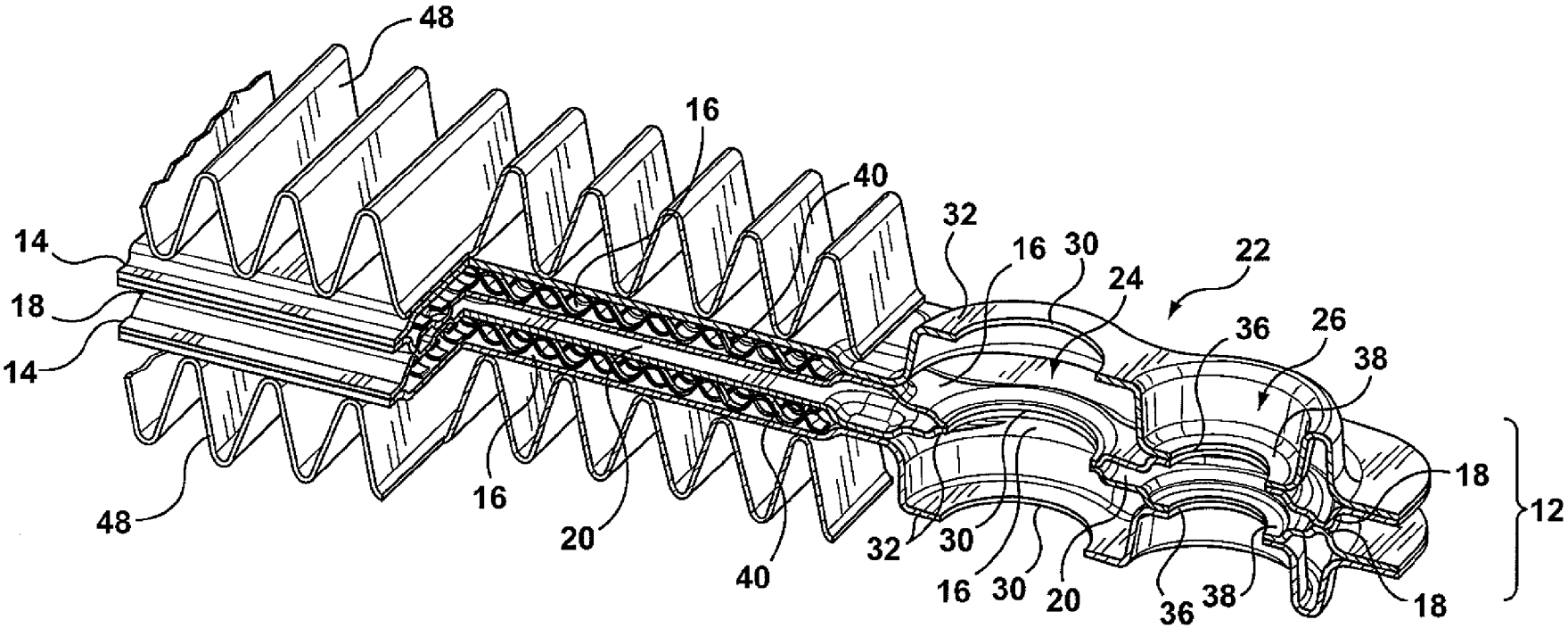
FIG. 3 is a perspective view of one of the double tube conduits and associated cooling fins shown in FIG. 2.

Referring firstly to FIGS. 1 to 5, a preferred embodiment of a heat exchanger according to the present invention is generally indicated by reference numeral 10. Heat exchanger 10 includes a plurality of elongate, tubular, double tube conduits 12 that are spaced apart for the flow of air between and around the conduits. The double tube conduits each include a pair of conduits or tubes 14 having internal flow passages 16. As seen best in FIGS. 4 and 5, the tubes 14 have raised peripheral edge portions 18 joined together to define an intermediate conduit or flow channel 20 between the two tubes 14 of each double tube conduit 12. However, only one of the tubes 14 needs to have a raised peripheral edge portion 18 joined to the other tube 14 to define the intermediate flow channels 20 therebetween. The intermediate conduits or flow channels 20 are located between at least two, but not all, of the spaced-apart tubes 14.

The double tube conduits 12 have opposed end portions 22 (only one of which is shown in the drawings). The opposed end portions 22 include a first manifold 24 and a second manifold 26. The first manifold 24 communicates with the internal flow passages 16, and the second manifold 26 communicates with the intermediates flow channels 20. The first manifolds 24 at the opposed end portions 22 of the double tube conduits 12 form a first pair of manifolds which include a first inlet manifold and a first outlet manifold depending upon which direction the fluid flows through internal flow passages 16. The second manifolds 26 at opposed end portions 22 of the double conduits 12 form a second pair of manifolds including a second inlet manifold and a second outlet manifold, again depending upon the direction that fluid flows through intermediate flow channel 20. Normally, a first inlet manifold 24 would be located or nested adjacent to or beside a second outlet manifold 26 making the exchanger 10 a counterflow type heat exchanger. However, heat exchanger 10 could be a parallel flow heat exchanger in which case a first inlet manifold 24 would be located adjacent to or nested beside a second inlet manifold 26. In other words, first inlet manifold 24 could be nested besides either a second inlet or a second outlet manifold 26, and first outlet manifold 24 could be nested beside either a second inlet or a second outlet manifold 26 depending upon the desired direction of fluid flow through the tubes 14.

The first inlet and outlet manifolds 24 located at the opposed end portions 22 of the double conduits 12 form a first pair of manifolds and these manifolds are formed by outwardly disposed bosses 28 (see FIG. 4) in each tube 14. The bosses 28 define aligned, transverse flow openings 30 therethrough and peripheral edge portions 32 surround the flow openings 30. The peripheral edge portions 32 are joined together in adjacent tubes 14 to form the first manifolds 24

Similarly, a second pair of manifolds 26 are formed by inwardly disposed bosses 34 (see FIG. 4) in each tube 14. The bosses 34 define aligned transverse flow openings 36 therethrough. Peripheral edge portions 38 surround the flow openings 36 and the peripheral edge portions 38 are joined together in adjacent tubes to form the second manifolds 26. It will be noted that the bosses 34 are located inside the raised peripheral edge portions 18.

Figure 4:
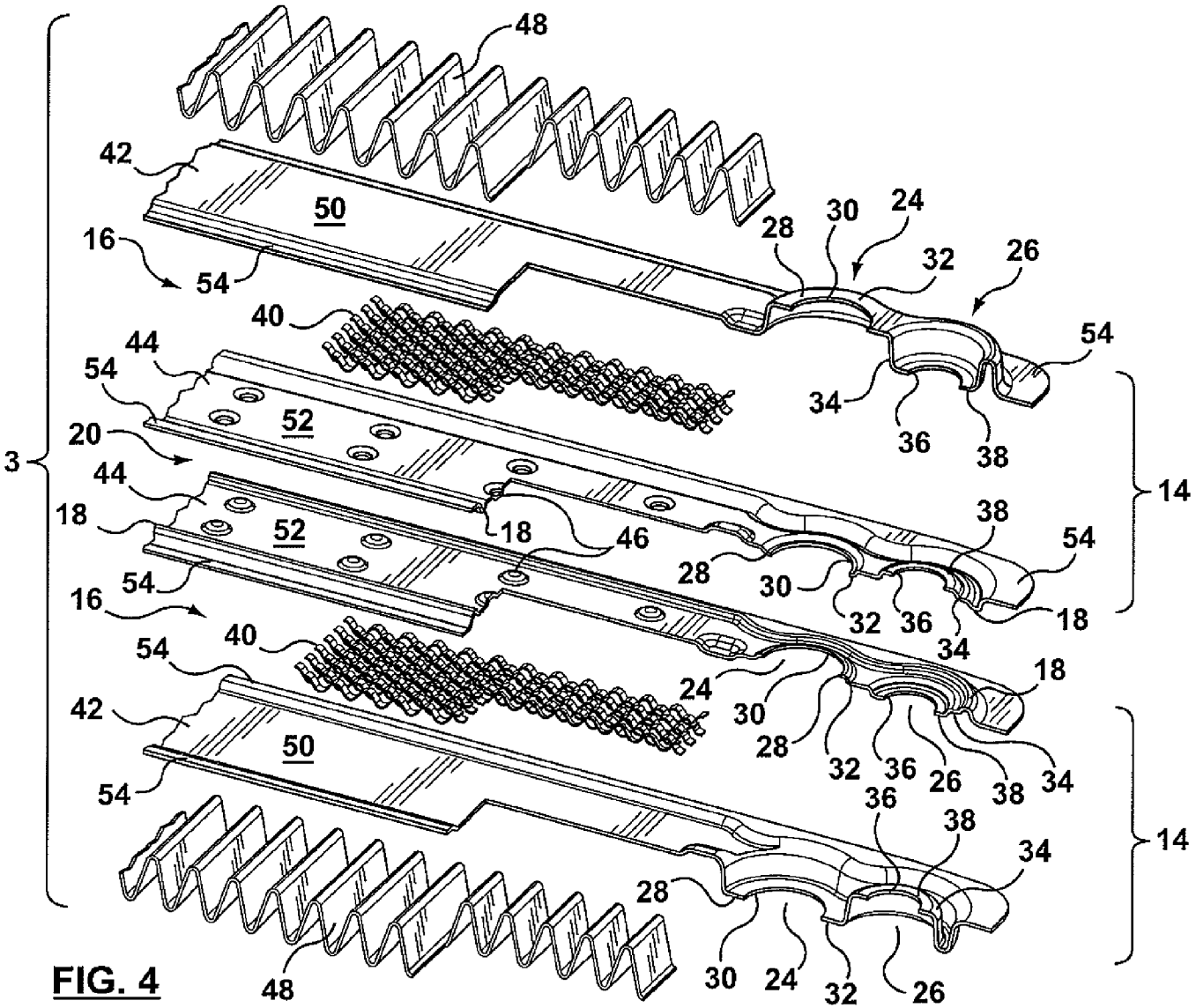
FIG. 4 is an exploded perspective view of the components shown in FIG. 3.

As seen best in FIG. 4, expanded metal turbulizers 40 are located in the internal flow passages 16. Tubes 14 have spaced-apart, parallel, planar walls 42, 44 that are in contact with turbulizers 40 and define a portion of the internal flow passages 16. The walls 44 that define a portion of the intermediate flow channels 20 have mating dimples 46 extending into the intermediate flow channels 20 to help cause mixing or perhaps turbulence inside intermediate flow channels 20. Cooling fins 48 are attached to one of the tubes 14 of each double tube conduit 12. The fins 48 extend between the bosses 28 and have a height twice that of the bosses 28, so that the fins 48 are in contact with the planar walls 42 of tubes 14. Fins 48 may be any conventional type, plain or louvered, as desired.

Figure 5:
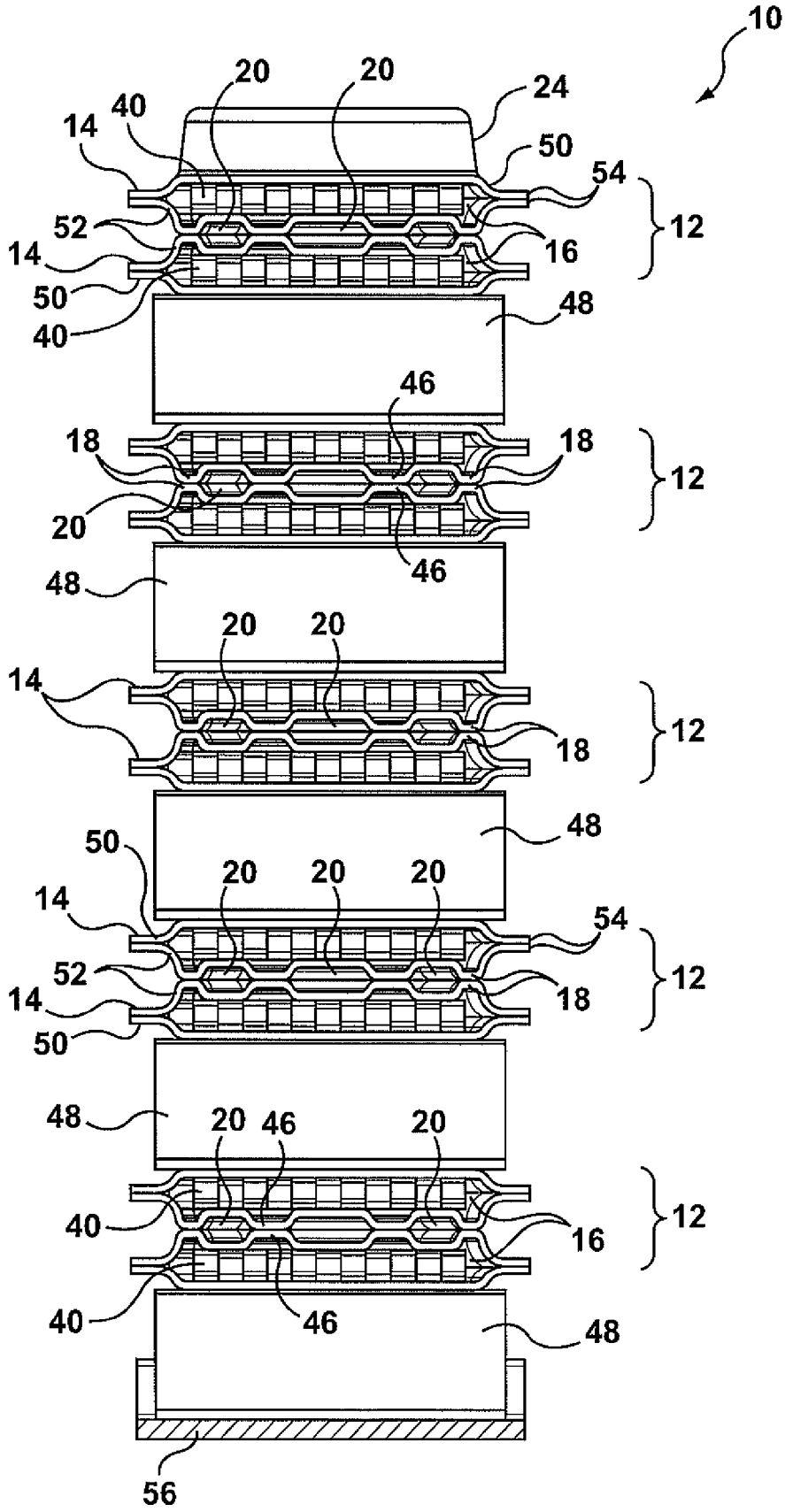
FIG. 5 is a vertical cross-sectional view taken along lines 5-5 of FIG. 1.

As seen best in FIGS. 4 and 5, the tubes 14 are formed of mating plates 50, 52 having raised peripheral flanges 54 joined together. The bosses 28 and 34 that form the first and second manifolds 24, 26 are located inside the peripheral flanges 54.

It will be noted that heat exchanger 10 is formed of two types of plates 50, 52. These plates are normally formed of brazing clad aluminum alloy. The fins 48 and turbulizers 40 are normally made of plain aluminum alloy. A bottom, thicker mounting plate 56 is normally used for supporting or mounting the heat exchanger. The heat exchanger is normally made by assembling all the desired types and number of plates, turbulizers and fins and brazing the parts together in a brazing furnace.

A preferred application for heat exchanger 10 would be as an oil to air heat exchanger with oil passing through the conduits or tubes 14 and air passing transversely between and around the double conduits 12 through fins 48. Another liquid, such as engine coolant, passes through intermediate conduits or flow channels 20. In this way, in cold start conditions, because engine coolant warms up faster than oil, the oil is warmed up by the coolant in intermediate conduits 20 to start the oil flowing earlier than would otherwise be the case. Also, in normal operating conditions, the coolant passing through intermediate conduits 20 augments or increases the heat transfer from the oil due to the additional heat transfer to the coolant in heat exchanger 10.

Figure 6:
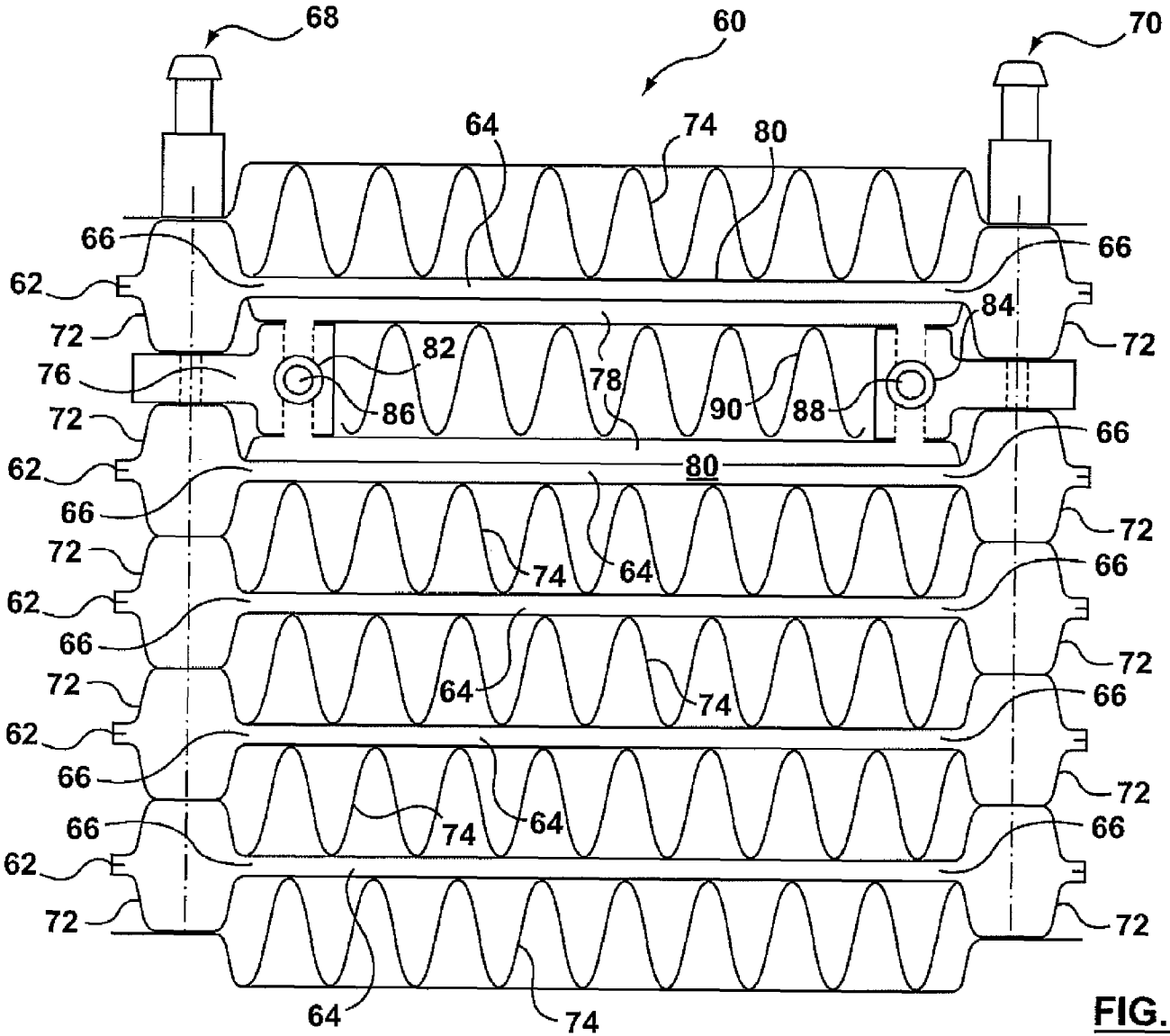
FIG. 6 is a diagrammatic elevational view of another preferred embodiment of a heat exchanger according to the present invention.

Referring next to FIG. 6, another preferred embodiment of a heat exchanger 60 according to the present invention is shown. Heat exchanger 60 is formed of at least three tubular conduits 62 defining internal flow passages 64 therein for the flow of a first fluid, such as a liquid, through heat exchanger 60. The tubular conduits 62 have opposed end portions 66 and the conduits 62, or at least the internal flow passages 64, are spaced apart for the flow of a second fluid, such as air, between and around the conduits 62.

A first pair of manifolds 68, 70, one of which is an inlet manifold and the other which is an outlet manifold, are located at and communicate with opposed end portions 66 and the internal flow passages 64. The manifolds 68, 70 are formed by enlarged bossed 72 at the opposed ends of the tubular conduits 62. The bosses 72 have transverse openings therein (not shown) for the flow of fluid along the length of the manifolds 68, 70.

Fins 74 are located between the tubular conduits 62 and expanded metal turbulizers (not shown) can be located inside internal flow passages 64 as well, if desired.

An intermediate conduit 76 is located between at least two, but not all, of the spaced-apart tubular conduits 62. Intermediate conduit 76 preferably includes a pair of parallel, flat tubes 78 joined to the portions of conduits 62 that define internal flow passages 64, the latter also being flat tubular portions 80 to give good surface-to-surface contact between the tubes 78 and the tubular portions 80. Inlet and outlet fittings 82, 84 define inlet and outlet openings 86, 88 for the flow of a second fluid, such as another liquid, through the intermediate conduit 76 for heat transfer between the first and second fluids. Another cooling fin 90 can be located between the flat tubes 78 of intermediate conduit 76, if desired.

A preferred application for heat exchanger 60 would be as a oil to air heat exchanger with oil passing through the conduits 62 and air passing transversely between and around the conduits 62 through fins 74. Usually, there are more than three tubular conduits 62, but preferably, there is only one intermediate conduit 76. Another liquid, such as engine coolant, passes through intermediate conduit 76. In this way, in cold start conditions, because engine coolant warms up faster than oil, the oil is warmed up by the coolant in intermediate conduit 76 to start the oil flowing earlier than would otherwise be the case. Also, in normal operating conditions, the coolant passing through intermediate conduit 76 augments or increases the heat transfer from the oil due to the additional heat transfer to the coolant in heat exchanger 60.

Having described preferred embodiments of the invention, it will be appreciated that various modifications may be made to these structures described above. For example, in the heat exchanger shown in FIGS. 1 to 5, the turbulizers 40 and dimples 46 could be eliminated or turbulizers could be used in intermediate flow channels 20 and mating dimples used in internal flow passages 16.

The first manifolds 24 are shown nested inside or inwardly of the second manifolds 26 along the longitudinal axis of heat exchanger 10, but the first and second manifolds 24, 26 could be offset laterally or their positions switched, as desired. And instead of using pairs of plates 50, 52 to form tubes 14, actual tubes could be used with suitable modifications for the formation or attachment of manifolds 24, 26.

Other structures could be used for the formation of first and second manifolds, 24, 26 as well, if desired.

In the embodiment shown in FIG. 6, instead of using two spaced-apart flat tubes 78 to form intermediate conduit 76, a single tube could be used for intermediate conduit 76. More than one intermediate conduit 76 could be used in heat exchanger 60, but it is preferred that intermediate conduits 76 not be used between every pair of tubular conduits 62. Other structures can be used for the formation of the manifolds 68, 70. Tubular conduits 62 could be made of plate pairs or tubes, as could the intermediate conduit 76.

From the foregoing, it will be evident to persons of ordinary skill in the art that the scope of the present invention is limited only by the accompanying claims, purposively construed.

The invention claimed is:

1. A heat exchanger comprising:

(a) a plurality of elongate, double tube conduits having opposed end portions, wherein each said double tube conduit comprises a first tube and a second tube, each said tube comprising a pair of planar walls which are arranged in spaced-apart, parallel, facing relation to one another, with an internal flow passage defined between the planar walls of each said tube, said first tube having a raised peripheral edge portion which extends along an entire outer periphery of said first tube and which is joined to an outer periphery of the second tube to define an intermediate flow channel between one said planar wall of said first tube and one said planar wall of said second tube, with said planar walls being in spaced-apart, parallel, facing relation to one another, wherein the internal flow passages and the intermediate flow channel extend between the opposed end portions of the double tube conduits, and wherein adjacent double tube conduits are arranged in spaced apart, parallel, facing relationship to one another to permit air to flow transversely between and around the double tube conduits;

(b) a first pair of manifolds including a first inlet manifold and a first outlet manifold located respectively at the opposed end portions of said double tube conduits, said first inlet and outlet manifolds being in communication with said internal flow passages of the first and second tubes making up said plurality of double tube conduits for the flow of a first fluid through the heat exchanger, wherein the first pair of manifolds is formed by outwardly disposed bosses in each said first tube and each said second tube, said bosses defining aligned, transverse flow openings therethrough and peripheral edge portions surrounding said flow openings, the peripheral edge portions being joined together so as to join together adjacent first and second tubes of each said double tube conduit, and so as to join together the tubes of adjacent double tube conduits, to form said first pair of manifolds;

(c) a second pair of manifolds in communication with said intermediate flow channel for the flow of a second fluid through the heat exchanger, the second pair of manifolds including a second inlet manifold and a second outlet manifold, the first inlet manifold being located beside one of the second inlet and outlet manifolds along the longitudinal axis of the heat exchanger, and the first outlet manifold being located beside the other of the second inlet and outlet manifolds along the longitudinal axis of the heat exchanger, the first pair of manifolds, therefore, being nested within the second pair of manifolds, wherein the second pair of manifolds is formed by inwardly disposed bosses in each tube, the inwardly disposed bosses being located inside said raised peripheral edge portion, said bosses defining aligned transverse flow openings therethrough; and (d) cooling fins located between the double tube conduits, wherein the cooling fins extend longitudinally between the bosses and are in contact with the planar walls of the first and second tubes.

2. A heat exchanger as claimed in claim 1 wherein each of the first and second tubes are formed of mating plate pairs having raised peripheral flanges joined together.

3. A heat exchanger as claimed in claim 1 wherein each of the first and second tubes are formed of mating plate pairs having raised peripheral flanges joined together, the said bosses being located inside the peripheral flanges.

4. A heat exchanger as claimed in claim 1 wherein both of said first and second tubes of each said double tube conduit have raised peripheral edge portions joined together to define said intermediate flow channel.

5. A heat exchanger as claimed in claim 1 wherein the cooling fins have a height twice that of the bosses.

6. A heat exchanger as claimed in claim 1 wherein said planar walls have mating dimples extending into the intermediate flow channel.

7. A heat exchanger as claimed in claim 1 further comprising turbulizers located inside each tube internal flow passage in contact with said planar walls.

8. A heat exchanger as claimed in claim 1, wherein the tubes are each formed of a mating pair of plates having raised peripheral flanges joined together and wherein the heat exchanger is formed of two types of said plates, such that all of the tubes are identical to one another.

9. A heat exchanger as claimed in claim 8, wherein each of the tubes is formed of a first type of said plate and a second type of said plate.

10. A heat exchanger as claimed in claim 9 wherein, in each of said double tube conduits, the second type of plate in one of the tubes is joined to the second type of plate in the other of the tubes.

11. A heat exchanger as claimed in claim 8, wherein each of the plates has a pair of opposed end portions, and wherein each of the opposed end portions of each of the plates is provided with one of said outwardly disposed bosses and one of said inwardly disposed bosses.

12. A heat exchanger as claimed in claim 1, wherein the outwardly disposed bosses of the first inlet manifold are nested beside the inwardly disposed bosses of one of the second manifolds, such that the peripheral edge portions of the outwardly disposed bosses surround the flow openings of both the inwardly and outwardly disposed bosses, and wherein each of the inwardly disposed bosses extends inwardly from the peripheral edge portion of one of the outwardly disposed bosses.

13. A heat exchanger as claimed in claim 1, wherein the outwardly disposed bosses of the first outlet manifold are nested beside the inwardly disposed bosses of one of the second manifolds, such that the peripheral edge portions of the outwardly disposed bosses surround the flow openings of both the inwardly and outwardly disposed bosses, and wherein each of the inwardly disposed bosses extends inwardly from the peripheral edge portion of one of the outwardly disposed bosses.

14. A heat exchanger as claimed in claim 1, wherein said internal flow passages are oil passages and said intermediate flow channels are engine coolant passages.

15. A heat exchanger as claimed in claim 1, wherein said intermediate channel is enveloped by the internal flow passages of the first and second tubes of the double tube conduits such that heat transfer occurs between: (i) the second fluid flowing through the intermediate channel and the first fluid flowing through the first and second tubes of the double tube conduits, and (ii) between the first fluid flowing through the first and second tubes of the double tube conduits and the air flowing transversely between and around said double tube conduits.

16. A liquid to air heat exchanger comprising:

at least three tubular conduits defining internal flow passages therein for the flow of a first liquid through the heat exchanger;

the tubular conduits having opposed end portions and being spaced apart for the flow of air between and around the conduits;

a first pair of manifolds including an inlet manifold and an outlet manifold located respectively at the opposed end portions in communication with said internal flow passages;

an intermediate conduit located between at least two, but not all, of the spaced-apart tubular conduits; and the intermediate conduit including inlet and outlet openings for the flow of a second liquid through the intermediate conduit for heat transfer between the first and second fluids;

wherein the intermediate conduit is a tubular member having opposed, parallel, planar walls, and wherein the tubular conduits are flat tubes overlying and being attached to said planar walls;

wherein the intermediate conduit includes a pair of parallel tubes attached to respective tubular conduits on either side of said parallel tubes, and further comprising inlet and outlet fittings defining the inlet and outlet openings for the flow of a second liquid through the intermediate conduit, the inlet and outlet fittings being inwardly disposed with respect to the first pair of manifolds along the longitudinal axis of the heat exchanger; and wherein the intermediate conduit parallel tubes are spaced apart for the flow of air therethrough and further comprising a cooling fin located between the parallel tubes and extending between the inlet and outlet fittings.

17. A heat exchanger as claimed in claim 16 wherein there are more than three of said tubular conduits and only one intermediate conduit located between a pre-selected pair of said tubular conduits.

18. A heat exchanger as claimed in claim 16, wherein said first liquid is oil and said second liquid is engine coolant.

* * * * *